United States Patent [19]

Ohuchi et al.

[11] Patent Number: 4,522,868

[45] Date of Patent: Jun. 11, 1985

[54] NEUTRON-SHIELDING FABRIC AND COMPOSITE FIBER AND METHOD OF MANUFACTURE THEREOF

[75] Inventors: Shigehiro Ohuchi, Otsu; Masao Kataoka, Kusatsu, both of Japan

[73] Assignee: Toray Industries, Inc., Tokyo, Japan

[21] Appl. No.: 406,450

[22] Filed: Aug. 9, 1982

[30] Foreign Application Priority Data

Feb. 1, 1980 [JP] Japan ..... 55-9944
Aug. 14, 1981 [JP] Japan ..... 56-126694

[51] Int. Cl.[3] ..... D02G 3/00

[52] U.S. Cl. ..... 428/224; 428/372; 428/373; 428/374

[58] Field of Search ..... 428/372, 373, 374, 224; 264/171

[56] References Cited

U.S. PATENT DOCUMENTS

| | | | |
|---|---|---|---|
| 2,796,411 | 6/1957 | Zirkle et al. | 524/404 X |
| 3,261,800 | 7/1966 | Collins | 524/404 X |
| 3,551,279 | 12/1970 | Ando et al. | 428/373 X |
| 3,616,183 | 10/1971 | Brayford et al. | 428/373 |
| 3,718,534 | 2/1973 | Okamoto et al. | 428/374 |
| 4,134,937 | 1/1979 | Cass et al. | 524/404 X |

FOREIGN PATENT DOCUMENTS

| | | | |
|---|---|---|---|
| 56-122848 | 9/1981 | Japan | 524/404 |

*Primary Examiner*—Lorraine T. Kendell

*Attorney, Agent, or Firm*—Wegner & Bretschneider

[57] ABSTRACT

This invention relates to the composite fiber incorporating the neutron-shielding properties consisting of a fiber-forming polymer as the core-component essentially containing certain compounds capable of shielding the neutrons and the other fiber-forming polymer as the sheath-component capable of bonding said core-component, while this invention also relates to the method of manufacturing said composite fiber embodied by this invention.

The composite fibers embodied by this invention are not only capable of containing a large amount of the neutron-shielding compounds in the fiber themselves, but also capable of being made into knits and sewn fabrics by means of conventional spinning, knitting and sewing machines, and yet, these fabrics made from said composite fibers can be completely free from drop-out of even the slightest amount of the neutron-shielding compounds during either fabrication procedures or use and also free from any problem that may potentially be caused by atmospheric diffusion of the secondary radioactive material generated by the nuclear reaction.

The neutron-shielding fabrics thus embodied will protect the surgical operators as well as the patients from any of the irradiated neutrons during surgical operations such as in removing cerebral tumor and also protect the operators of the nuclear-reactor from potential hazard of exposure to the neutron rays.

9 Claims, No Drawings

NEUTRON-SHIELDING FABRIC AND COMPOSITE FIBER AND METHOD OF MANUFACTURE THEREOF

FIELD OF THE INVENTION

This invention relates to woven, non-woven and knitted fabrics and composite fibers for use therein having extremely effective neutron shielding properties, particularly against thermal neutrons, combining low emission of secondary radiation with high flexibility, as well as to the method of manufacturing these fabrics and neutron-shielding fibers.

BACKGROUND OF THE INVENTION

In view of the recent significant development of the nuclear industry, a variety of problems have emerged with respect to potential hazard and exposing workers to radioactive materials and radiation in nuclear plants. During the periodic maintenance and repair work carried out in nuclear power stations, it is absolutely necessary not only to protect workers from intense radiations such as gamma ($\gamma$) rays, but also from exposure to even the slightest amount of neutrons, which can radiate from the nuclear reactor in the event of an emergency.

The nuclear industry has thus urgently desired to have available neutron shielding materials of high flexibility and desirable operative properties for incorporation into garments, so that workers in nuclear plants and industrial sites can wear protective garments made of neutron-shielding material.

The importance of this invention has recently increased in view of the various experiments relating to the application of neutron radiation to medical treatment, such as neutron capture therapy, where a certain amount of neutrons is irradiated to a cerebral tumor so that only the tumor portion is effected and can thus be removed. During this surgical procedure, it is essential to protect the rest of the patient's body from the neutron radiation itself as well as to the secondary radiation produced when neutrons strike their target. In this case, it is an urgent need in the art to fabricate neutron-shielding materials in the shape of fabrics such as bandages, gauzes and blankets. This demand can potentially be satisfied only by the use of fiber materials having the necessary neutron shielding properties.

Further, in the event that neutron weapons are used in warfare, although the neutron-shielding fabrics and fibers of this invention will not shield against any of the fast neutrons emitted therefrom, if people wore protective robes of the neutron-shielding fibers of this invention and were situated in shelters that provide the effect of reducing the energy of fast neutrons so as to slow them to thermal neutrons, peoples' lives could be saved by the shielding effect provided by the fabrics of this invention. The neutron-shielding material in accordance with this invention potentially have any possible utility relating to the protection of humans, animals and inanimate objects from thermal neutron radiation.

Conventional neutron-shielding materials are in the form of boards composed of cadmium and boron compound. However, such neutron-shielding boards are physically rigid and have no flexibility at all; furthermore, since cadmium yields high secondary gamma rays upon absorbing neutrons, it is not suitable for use in shields for protecting the human body against neutron radiation.

Japanese laid-open patent applications Nos. 52-127597 and 52-131097 disclose neutron shielding materials formed in sheets of various kinds of plastics with boron and/or lithium compounds therein, which are disclosed to yield low levels of secondary gamma radiation in the occasion of neutron absorption. However, these products are not flexible enough for use in any of the protective clothing and the like contemplated by this invention. Another Japanese laid-open patent application, No. 53-21398, discloses a method of manufacturing neutron shielding fibers which consist either of ion exchange fibers which have absorbed therein ionized compounds of boron and lithium or of staple-like fibers containing therein boron and/or lithium compounds. In the case of the ion exchange fibers, the finished products cannot satisfactorily achieve the intended shielding properties to either the incomplete absorption and fixation of the neutron-shielding ionized compounds into the ion exchange fibers, or to the possible releasing of the once-fixed ionized compounds from the fibers during the washing and rinsing the fabrics embodying these fibers.

In the case of staple fibers, the finished products thus obtained by means of jet-spinning of this mixture of neutron-shielding inorganic compounds and fiber-forming polymers can physically retain the fibrous form. However, these products are not suitable for processing with any of the yarn-spinning and knitting or texturizing machines due to insufficient tensile strength, elongation, and textured styles. In addition, the finished products thus obtained usually have those neutron-shielding compounds exposed on the surface, and thus they can easily be stripped off from the surface, thus inevitably resulting in degraded shielding properties.

We have carried out extensive experiments with fibers composed of certain fiber-forming polymers, each having certain grading and neutron-shielding properties. As a result, we found that a variety of critical problems potentially existed. For example, certain neutron-shielding compounds deposited and existed on the surface and the adjacent portions of the fibers were found to be stripped off in processing, thus causing damage on the surfaces of guide rollers and other rollers due either to staining or to friction of the fibers against them. Consequently, not only can the production of the neutron-shielding fibers of stable quality not be achieved, but the finished fibers will have poor mechanical properties. In addition, neutron-shielding garments made of said compound fibers exhibit eventual stripping off of the deposited neutron-shielding compounds during and after wash and from friction of the fabric against objects.

We also found that, when these prior finished products composed of neutron-shielding fibers were exposed to neutron rays, certain secondary radioactive materials were generated by the nuclear reaction. For example, when lithium (Li) compounds were applied to the neutron-shielding compound, the lithium compounds exposed to the thermal neutron rays irradiated onto the fiber surface then generated a certain amount of tritium which then started to diffuse in the atmosphere.

SUMMARY OF THE INVENTION

This invention involves incorporating certain fiber-forming polymers (A) in a core which essentially contains at least 5% by weight, preferably within a range from 10% to 60% by weight, of certain compounds having effective properties to screen thermal neutrons, each having a maximum particle diameter of about 25 microns, preferably a maximum of 15 microns whereas the other component consists of at least one kind of fiber-forming polymer (B) as the sheath-component that essentially bonds the above core-component (A), so that both components are made into the composite fibers incorporating the neutron-shielding properties. The invention also includes the method of manufacturing said composite fibers.

Relating to this invention, more preferably, the sheath-component should consist of fiber-forming polymers having a viscosity ranging from 0.2 to 0.9 of that of said core-component polymer.

This invention has enabled us to manufacture neutron-shielding fibers that sufficiently satisfy the various practical requirements in shielding from the neutrons, minimizing the gamma rays secondarily generated, and yet providing said fibers with sufficient mechanical properties without causing any of the neutron-shielding compounds to go off from the surface of said fibers so that the neutron-shielding properties will remain stable. As a result, this invention has enabled us to manufacture neutron-shielding fabrics with sufficient flexibility based on said fibers, so that garments effective in shielding against thermal neutrons may be made that will retain their neutron-shielding.

DETAILED DESCRIPTION OF THE INVENTION

Compounds preferred for use in this invention having the desired properties in effective shielding from the neutrons and being contained in the core-component polymer (A) that constitutes the composite fiber by this invention should be chemically stable and physically capable of absorbing thermal neutrons and minimizing or voiding radioactive rays such as secondary gamma rays. Such compounds should preferably be selected from any of the elements containing isotopes, specifically, such as $^{6}Li$ and/or $^{10}B$.

Conventionally, these natural isotopes exist at a rate of about 7% to 8% in the case of the isotope $^{6}Li$ and about 19% to 20% in the case of the isotope $^{10}B$. In order to implement this invention, it is preferable to select those naturally available lithium compounds and/or boron compounds containing said isotopes, for example, such as lithium carbonate, lithium fluoride, boric acid, boron carbide, boron nitride, etc. It is more advantageous to use certain compounds composed of artificially separated and enriched isotopes.

When adding said neutron-shielding compounds to the core-component polymer (A), it is important that the particles of said neutron-shielding compounds should essentially have a maximum size of not more than 25 microns in diameter, preferably fine particles having diameters less than 15 microns.

If these ranges are not correctly satisfied, the mixed compound is difficult to join into fibers, thus eventually resulting in poor mechanical properties for the made-up fibers.

When mixing said neutron-shielding compounds with the core-component polymer (A), it is also important that said neutron-shielding compounds should be mixed into said core-component polymer at a ratio of at least 5% by weight, preferably within a range between 10% to 60% by weight. If said mixture ratio is below 5% by weight, the eventually obtained neutron-shielding properties will be lower than needed. Conversely, if the neutron-shielding compounds are mixed with the core-component polymers by more than 60% by weight, even though the eventually obtained neutron-shielding properties will be promoted, the texturizing process will become difficult, thus eventually resulting in poor mechanical properties of the fibers themselves and garments from which they are made.

The core-component (A) that essentially composes the composite fiber may be chosen from a variety of known fiber-making raw materials, for example, such as polyester, polyamide, polyolefin polymers, etc. In this invention, it is preferred to select any of the suitable polymers that can be spun into yarns in order to have the neutron-shielding compounds evenly mixed and dispersed into the selected polymers.

Taking stability against the neutron rays into consideration, it is more advantageous to choose polyethylene and certain co-polymers mainly composed of polyethylene, such as with less than 10 mol. % of vinylacetate, propylene alph-olefin (1-butene or 1-penten) and vinylcarbazole, for suitable core-component polymers.

This invention does not specifically define any particular material to be used for the sheath-component (B) that also constitutes said Composite Fiber provided that the used material can properly be bonded with the core-component (A). It is however preferable that the sheath-component (B) falls under the same category as the core-component (A). Further, it is preferable in implementing this invention that the composite ratio of the core-component against the sheath-component polymer remains within a range from 0.5 up to 10. That is to say, if the actual composite ratio does not meet the desired range, for example, if the core-versus-sheath composite ratio exceeds a maximum of 10, the covering property of the sheath-component polymer will then become unstable, and may eventually cause the core-component polymer to bare itself.

The neutron-absorbing compounds in the bare core component polymer may fall from the fibers during spinning, or they may fall off later, possibly diffusing into the environment the radioactive materials secondarily generated during exposure to neutrons.

Conversely, if the core-versus-sheath composite ratio is below 0.5, since the core-component polymer containing the neutron-shielding compounds will decrease based on the sectional areas of the composite fibers, the originally-aimed neutron-shielding properties will eventually lower, causing undesired results.

We have finally found that the core-versus-sheath polymer composite ratio should preferably remain within a range of 1 to 4, thus enabling the sheath-component to cover the neutron-shielding compounds sufficiently without any dropping off at all and thus sealing even the slightest amount of the radioactive materials generated by the irradiated neutron rays inside the core-component polymer without any fear of their emission into the atmosphere, and at the same time, in so doing, this invention has eventually enabled us to obtain the core-and-sheath-integrated composite fibers that are sufficiently capable of shielding from neutrons.

As one of the significant characteristics in the process of manufacturing the core-and-sheath composite fibers based on this invention, we have also found that, when certain spun yarns made of core-and-sheath composite fibers are applied to the implementation of this invention by using a spinneret for the composite spinning of conventional synthetic fibers, the ratio between the melt-viscosity X of the core-component (A) containing the neutron-shielding compounds and the melt-viscosity Y of the sheath-component (B) plays a very important role. That is to say, when a certain melt-viscosity ratio was provided under the optimum spinning temperature conditions, i.e., when the value of Y/X was within the range of 0.2 to 0.9, in particular, when this value satisfied a range between 0.3 to 0.7, it was found that the core-and-sheath composite fibers could stably be spun into the intended textured yarns.

If the melt-viscosity ratio does not meet the recommended range as referred to above, spinning of such composite fibers is difficult to stably be performed, and the spun-fibers will often be cut during the spinning process, thus making it difficult to satisfactorily perform the spinning operation.

It is, however, not certain why such a phenomenon should occur, although this is considered due to one of the potentially peculiar phenomena incidental to core-and-sheath composite fibers where relatively large amount of neutron-shielding particles is added to the core-component.

The composite fibers produced by this invention and their secondary products, for example, those fabrics typically represented by woven-fabrics, knitted fabrics and non-woven fabrics are provided with very excellent properties in neutron shielding, particularly in thermal neutron shielding without generating intense secondary radioactive rays, being totally free from stripping of the fixed neutron-shielding compounds from the processed fabrics which are not only highly durable in neutron-shielding properties but can also effectively be applied to garments for protecting humans against the attack of neutrons owing to their fiber characteristics which can provide such garments with mechanical properties common to any of the conventional fibers and with high flexibility.

As a result, such human-protective garments made of the neutron-shielding composite fibers will effectively provide very advantageous performance and useful values in the nuclear industry. This invention is described by some examples shown below.

EXAMPLE NO. 1

First, a total amount of 500 grams of fine LiF powder containing more than 95% of the enriched isotope of lithium$^6$, where the particles of said powder had a maximum diameter of about 8 micron, and about 2.5 micron mean volume diameter, was mixed with a total amount of 750 grams of high-density polyethylene powder (typically, "HIZEX" 2100 GP, a product of Mitsui Petrochemical Company, Japan) by means of a Henschel mixer.

The mixed material was then subjected to kneadings three times repeatedly by means of an extruder (having a 30 mm cylindrical diameter and a 500 mm screw length), employing a 60 rmp screw revolution and at temperatures ranging from 250° to 280° C.

After these procedures were completed, an amount of mixture was obtained, which consisted of polyethylene chips mixed with fine $^6$LiF powder, where the net content of said $^6$LiF was measured at 38.5% by weight. Separately, the melt-viscosity of said polyethylene chip was measured at 260° C. by means of the "KOKA" type flow-tester manufactured by Shimazu Seisakusho, Ltd., Japan, showing a melt-viscosity of 2,520 poises.

Using said $^6$LiF-containing chips as the core-component and a certain amount of high-density polyethylene (typically, "HIZEX" 1300J, a product of Mitsui Petrochemical Company, Japan) as the sheath-component, the melt-viscosity of which was measured at 1,760 poises under the same test conditions as above, we carried out the spinning of the core-and-sheath composite fibers by means of concentric composite spinnerets each having 12 holes of 0.65 mm diameter. The spinning operation was stably performed under the prepared operative conditions so that 12 grams per minute of the output of the core-component and 5 grams per minute of the output of the sheath-component were obtained at 260° C. and at a take-up speed of 450 meter per minute.

We then observed the mono-filament sections of the spun-yarns through an optical microscope under the light penetration. As a result, we could confirm that the spun-yarns thus obtained had evenly concentric core-and-sheath composite fibers where the core-component contained a specific amount of said LiF fine particles.

In the following test carried out by us, these composite fibers were elongated to a draw ratio of 5.0 on a plate heated to 95° C. We thus successfully obtained the desired continuous filaments made of the core-and-sheath composite fibers.

These filaments were eventually found useful enough in mechanical characteristics with their tensile strength of 2.5 grams per denier and 25% elongation.

EXAMPLE NO. 2

The continuous filaments obtained by the preceding procedure of Example 1 were then integrated so that each of the integrated yarns contained 60 filaments, which were then processed by a knitting machine in order to experimentally make tubular knitted fabrics. After the knitting, the knit fabric had a 1.30 mm thickness and a density of 490 grams per square meter of area.

The shielding properties of these knit fabrics against the thermal neutrons were then evaluated. Tests were carried out in the thermal neutron standard field based on the Maxwellian distribution by means of the KUR heavy water facilities, where the shielding effect of these knit fabrics against the broad thermal neutron rays were measured by activated gold (Au) foils. Test results for the neutron-shielding properties are shown in Table 1 below.

TABLE No. 1

The thermal neutron-shielding properties of the knitted fabrics composed of $^6$LiF—mixed filaments.

| Number of plies of knitted fabric. | 1 | 4 | 6 | 10 |
|---|---|---|---|---|
| Thickness (mm) of the knitted fabric. | 1.30 | 5.20 | 7.80 | 13.0 |
| Transmittance of thermal neutrons. | $6.4 \times 10^{-1}$ | $1.5 \times 10^{-1}$ | $4.8 \times 10^{-2}$ | $1.4 \times 10^{-2}$ |

EXAMPLE NO. 3

As was done in the preceding Example No. 1, a total of 750 grams of fine particles "$B_4C$" (typically, "DENKA BORON" No. 1200, a product of Denki Kagaku Kogyo K.K., Japan) graded by dry separation to have a maximum diameter of 10 microns diameter and 3.2 microns of mean volume diameter was mixed with a total of 1,000 grams of high-density polyethylene powder (typically, "HIZEX" 2100GP, a product of Mitsui Petrochemical Company, Japan), then the mixture was kneaded by an extruder, thus producing an amount of polyethylene chips containing uniformly dispersed fine powder $B_4C$. Our analysis indicated that the polyethylene chips contained 42% by weight of this $B_4C$ component. Based on the same method as was done in the Example No. 1 procedure, the melt-viscosity of said mixture was measured to be 2,690 poises at 260° C.

Using this $B_4C$-containing polyethylene chip as the core-component and a certain amount of middle-density polyethylene (typically, "NEOZEX" 45300, a product of Mitsui Petrochemical Company, Japan) as the sheath-component, the melt-viscosity of which was measured at 1,000 poises under the same test condition as above, the spinning of the core-and-sheath composite fibers was carried out by employing the concentric composite spinnerets each having 12 holes of 0.50 mm diameter. The spinning operation was stably performed under the prepared operative conditions so that 10 grams per minute of the output of the core-component and 4.5 grams per minute of the output of the sheath-component were obtained at 260° C. and at a take-up speed of 400 meters per minute.

The mono-filament sections of the spun yarns were then observed through an optical microscope under the light penetration. As a result, it was confirmed that the spun-yarns thus obtained showed evenly concentric core-and-sheath composite fibers where the core-component contained a specific amount of said fine $B_4C$ particles.

In the following test carried out by us, these composite fibers were elongated at a draw ratio of 5.5 on a plate heated to 95° C. The desired continuous filaments were thus made of the core-and-sheath composite fibers.

These filaments were eventually found useful enough with their tensile strength 2.3 grams per denier and 21% elongation.

EXAMPLE NO. 4

The continuous filaments obtained by the preceding procedure of Example 3 were then integrated so that each of the integrated yarns contained 48 filaments, which were then processed by a knitting machine in order to experimentally make tubular knitted fabrics. After the knitting, the knit fabric had a 1.25 mm thickness and a density of 430 grams per square meter of area.

The shielding properties of these knit fabrics against the thermal neutrons were then evaluated. Tests were carried out at the same site and with the same methods as were used for the Example 2 tests. Test results for the neutron-shielding properties are shown in Table 2 below.

TABLE No. 2

| | | | | |
|---|---|---|---|---|
| Number of plies of knitted fabric. | 1 | 4 | 6 | 10 |
| Thickness (mm) of the knitted fabric. | 1.25 | 5.0 | 7.5 | 12.5 |
| Transmittance of thermal neutrons. | $6.0 \times 10^{-1}$ | $1.1 \times 10^{-1}$ | $4.4 \times 10^{-2}$ | $1.1 \times 10^{-2}$ |

EXAMPLE NO. 5

As was done in the preceding Example 1 and using the same methods as Example 1, a certain amount of boron nitride fine powder (typically, a boron nitride product made by Denki Kagaku Kogyo K.K., Japan) is mixed and kneaded with a certain amount of high-density polyethylene powder (typically, "HIZEX"1300J, a product of Mitsui Petrochemical Company, Japan) by means of a Henschel mixer, and as a result, a certain amount of polyethylene chips containing 55% by weight of boron nitride was obtained, which had a 2,900 poise melt-viscosity at 250° C.

Using these polyethylene chips containing boron nitride as the core-component and an amount of said high-density polyethylene powder without containing boron nitride having a 2,000 poise melt-viscosity at 250° C., core-and-sheath composite fibers were spun. The spinning operation was stably performed at 250° C. and at a take-up speed of 500 meters per minute so that the output ratio of the core component polymer to sheath component polymer became almost 2, and as a result, it was confirmed that the spun-yarns thus obtained had evenly concentric core-and-sheath composite fibers.

After the following procedure in elongating the composite fibers 4.5 times the original length on the plate heated at 95° C., very satisfactory continuous filaments having a 3.0 grams per denier tensile strength and 32% elongation were obtained.

The inventors then processed the obtained filaments into a taffeta of 0.50 mm thickness and a density of 250 grams per square meter of area. The thermal-neutron-shielding properties of the taffeta were tested at the same site as that was used for the Example 2 tests. When 10 pieces of said taffeta were piled up, forming 5 mm of total thickness, the amount of the thermal neutrons actually penetrating was was measured at $2.0 \times 10^{-2}$.

What is claimed is:

1. A neutron shielding composite fiber comprising (a) a core component of fiber-forming polymer (A) containing at least 5 weight percent of an isotope compound in particles with maximum diameters of 25 microns, capable of shielding against thermal neutrons, and (b) a sheath component of a fiber-forming polymer (B) which is capable of bonding to said fiber-forming polymer (A).

2. A neutron-shielding composite fiber of claim 1, wherein the neutron shielding isotope compound contains $^6Li$, $^{10}B$ or a mixture thereof.

3. A neutron-shielding composite fiber of claim 1 or 2, wherein the fiber-forming polymers (A) and (B) are polyethylene or a polyethylene co-polymer.

4. A neutron-shielding composite fiber of claim 1 or 2, wherein the composite ratio of core component to sheath component is from 0.5 to 10.

5. A neutron-shielding composite fiber of claim 1 or 2, wherein the neutron-shielding isotope compound particles have a maximum diameter of 15 microns.

6. A neutron-shielding composite fiber of claim 1 or 2, wherein the core component contains from 10 to 60 weight percent of neutron-shielding isotope compounds.

7. A neutron-shielding composite fiber of claim 1 or 2, wherein the melt viscosity ratio of sheath component (B) to core component (A) is from about 0.2 to 0.9.

8. A knitted, woven or non-woven fabric made from the fiber of claim 2.

9. A knitted, woven or non-woven fabric made from the fiber of claim 3.

* * * * *